US005219467A

United States Patent [19]

Nyman et al.

[11] Patent Number: 5,219,467

[45] Date of Patent: Jun. 15, 1993

[54] METHOD FOR CONCENTRATING ORE SLURRIES BY MEANS OF INTENSIVE AGITATION CONDITIONING AND SIMULTANEOUS FLOTATION, AND AN APPARATUS FOR THE SAME

[75] Inventors: Bror G. Nyman, Ulvila; Seppo S. Jounela, Espoo; Launo L. Lilja; Valto J. Mäkitalo, both of Pori, all of Finland

[73] Assignee: Outokumpu Research Oy, Pori, Finland

[21] Appl. No.: 892,351

[22] Filed: Jun. 2, 1992

[30] Foreign Application Priority Data

Jun. 5, 1991 [FI] Finland ..... 912696

[51] Int. Cl.[5] ..... B03D 1/02; B03D 1/16

[52] U.S. Cl. ..... 209/164; 209/169; 366/102; 261/87

[58] Field of Search ..... 209/164, 169, 170; 366/102; 261/87; 210/221.1

[56] References Cited

U.S. PATENT DOCUMENTS

| | | | |
|---|---|---|---|
| 1,155,816 | 10/1915 | Higgins | 209/169 |
| 1,155,836 | 10/1915 | Owen | 209/169 |
| 1,155,861 | 10/1915 | Wood | 209/169 |
| 1,195,453 | 8/1916 | Fagergren | 209/169 |
| 1,588,077 | 6/1926 | Wilkinson | 209/169 |
| 2,061,564 | 11/1936 | Drake | 209/169 |
| 2,178,239 | 10/1939 | McKenna | 209/169 |
| 2,609,097 | 9/1952 | Dering | 209/169 |
| 3,037,626 | 6/1962 | Takahashi | 209/169 |
| 3,050,188 | 8/1962 | Nisser | 209/169 |
| 3,409,130 | 11/1968 | Nakamura | 209/169 |
| 3,414,245 | 12/1968 | Frazer | 209/169 |
| 3,979,282 | 9/1976 | Cundy | 209/169 |
| 4,028,229 | 6/1977 | Dell | 209/169 |
| 4,165,279 | 8/1979 | Dell | 209/169 |
| 4,231,860 | 11/1980 | Kuznetsov | 209/169 |
| 4,247,391 | 1/1981 | Lloyd | 209/169 |
| 4,277,328 | 7/1981 | Pfalzer | 209/169 |

FOREIGN PATENT DOCUMENTS

| | | | |
|---|---|---|---|
| 807262 | 4/1951 | Fed. Rep. of Germany | 209/169 |
| 1387502 | 12/1964 | France | 209/169 |

OTHER PUBLICATIONS

Peter Young, "Flotation Machines", Mining Magazine Jan., 1982, pp. 35–59.

*Primary Examiner*—Thomas M. Lithgow
*Attorney, Agent, or Firm*—Brooks Haidt Haffner & Delahunty

[57] ABSTRACT

The present invention relates to a method for concentrating a certain mineral fraction attached to air bubbles from a slurry to the foam layer accumulated on the surface, so that the concentration takes place in three different mixing zones. The apparatus of the invention is formed of a colon-like flotation arrangement and of flow guides, a flow attenuator and an agitator belonging thereto. The flotation reactions are created in the bottom zone, wherefrom air bubbles and mineral particles carried by them are directed in a controlled fashion onto the surface of the apparatus. The flotation apparatus is so designed, that a strong agitation in the bottom zone can be used without causing harmful separation of the foam in the bottom part of the apparatus.

3 Claims, 3 Drawing Sheets

METHOD FOR CONCENTRATING ORE SLURRIES BY MEANS OF INTENSIVE AGITATION CONDITIONING AND SIMULTANEOUS FLOTATION, AND AN APPARATUS FOR THE SAME

BACKGROUND OF THE INVENTION

The present invention relates to a method for concentrating a certain mineral fraction attached to air bubbles from a slurry to the foam layer accumulated on the surface, so that the concentration takes place in three different mixing zones. The apparatus of the invention is formed of a colon-like flotation arrangement and of flow guides, a flow attenuator and an agitator belonging thereto. The flotation reactions are created in the bottom zone, wherefrom air bubbles and mineral particles carried by them are directed in a controlled fashion onto the surface of the apparatus. The flotation apparatus is so designed, that a strong agitation in the bottom zone can be applied without causing harmful separation of the foam in the bottom part of the apparatus.

A widely used flotation principle is the rotor/stator principle, according to which the rotor, which is small with respect to the size of the flotation cell, rotates in the middle of the stator structure. In these cases, the rotor size is normally below 0.3 times the diameter or width of the cell. The object of this method is that in a limited space, the shearing speeds of the agitation are increased in order to achieve the desired air dispersion. In the same elongate cell, there are often used two rotor/stator structures, but the strong mixing treatment of the slurry still remains rather short, because the mixing effect outside the rotor/stator structure is not strong. Especially in large flotation cells, an attenuation of the mixing effect of the rotors by means of stators leads to difficulties in the fluidization of solid particles. The mixture is so nonhomogeneous that the coarser mineral material settles onto the bottom of the cells, although it is attempted to prevent this type of sand accumulation by increasing the rotation speed of the rotor.

SUMMARY OF THE INVENTION

According to the present invention, the whole bottom i.e. reactor part of the flotation apparatus is mixed evenly and powerfully, when using the agitator and agitation baffle plate embodiments typical of the invention, which raise the shearing speeds directed to the slurry under treatment, i.e. increase the rapidly direction-changing turbulences. In order to prevent the turbulent mixing flow from breaking the concentrate foam layer gathered on the surface, and from disturbing the concentrate particles rising towards the surface carried by air bubbles, the surface zone is separated from the reactor zone by means of a separate intermediate zone along with agitation attenuators and flotation-regulating air separators pertaining thereto. The concentrate separation is further boosted by a surface zone, i.e. a colon zone, located above the intermediate zone; this colon zone can be provided with baffle plate constructions for an attenuated orientation of the flows.

New ideas in flotation are represented by the procedure of the present invention, where the power of agitation is deliberately increased over the level normally used in flotation. Earlier the power of agitation was maintained at about 1 kW per average cell cubic meter, and this mixing power was distributed unevenly and powerfully only to the small space limited by the stator structure. According to the present invention, the whole bottom zone, i.e. the reactor zone, of the flotation apparatus is agitated powerfully and evenly, so that the power of agitation rises up to 1.5–10 kW/m$^3$ and is normally between 2–3 kW/m$^3$.

The intermediate zone located above the reactor zone is characterized in that by means of the attenuating structures provided therein, there is created a steep vertical gradient of agitation intensity, so that the power of agitation per volume is lowered to below 0.2 kW/m$^3$ before the beginning of the topmost zone, the colon zone. The structures of the intermediate zone turn the major part of the mixing flows downwards, so that hardly any agitation turbulence penetrates the colon zone itself. With this procedure, the agitation is further attenuated in the colon zone proper, and in the top part of this zone the agitation remains within a rate below 0.1 kW/m$^3$. This ensures that the concentrate particles can rise up towards the surface undisturbed.

An advantage of the above described general arrangement is that the ore slurry under flotation treatment can be powerfully agitated without disturbing the simultaneous rising of the concentrate up to the surface layer. Thus a separate pre-flotation conditioning can often be avoided, because in this so-called COINS method (conditioning and in-situ flotation), flotation is connected to conditioning. At the same time the conditioning treatment itself is shortened, which has the advantage that the covering of the particle surfaces by side-products created in undesirable surface reactions, for instance by secondary sulphur compounds, is remarkably decreased. The employed flotation chemicals react selectively with the surfaces of the mineral particles under flotation.

Powerful mixing also has the advantage that the flocculation of mineral particles which causes difficulties in the flotation can be dissolved. In conventional flotation, a powerful agitation takes place at the conditioning stage, and not so much in connection with flotation anymore, so that flocculation at the flotation stage is common. In our method, powerful agitation is carried out at the flotation stage too, wherefore flocculation is decreased while flotation proceeds. Particularly when treating finely divided ore slurries, powerful agitation is a basic prerequisite for successful flotation. This requires strong and rapidly direction-changing agitation turbulences, in order to create sufficient differences between the mineral particles and air bubbles, i.e. in order to make these collide so powerfully that the mineral particles are attached to the air bubbles and flotation takes place. Another apparent advantage from powerful mixing is that even the coarse particles contained in the mineral slurry cannot settle onto the bottom of the reactor and disturb the operation of the flotation apparatus.

A conventional flotation apparatus generally is an elongate cell arrangement, where the feeding is arranged at one end near the bottom, and the slurry also is let out near the bottom. According to our invention, the powerful agitation allows to change this arrangement and to achieve a more effective flotation treatment. The slurry is subjected to a more homogeneous treatment while the direct flowthrough ratio is decreased, when the outlet pipe is installed up in the intermediate zone. The processing time of solids, and particularly coarse solids, can be extended by arranging the the outlet pipe higher in the intermediate zone, where the intensity of mixing decreases sharply while proceeding further up.

The whole circumference of the top end of the flotation reactor forms an even overflow threshold to the concentrate, wherefrom the flotated concentrate flows down to the surrounding chute. While proceeding to the bottom part of the colon zone, the mechanical agitation power is decreased to a rate where the rising of the mineral particles to the surface depends almost completely on air bubbles.

The level of the mechanical agitation penetrating through the intermediate zone can be adjusted by vertically changing the position of the agitation attenuator located in the intermediate zone. In similar fashion, the flows of the colon zone can be adjusted by the same procedure. In practice this means that there is searched a running point where the central flows of the colon zone are slowly rising, so that the surface flows from the center outwards carry the separated concentrate into the chute. The lowering of the flow attenuator increases the amount of air separated in the colon zone, for instance, so that respectively more air can be fed into the lowest reactor zone. This procedure intensifies the upwards directed flows in the center of the colon zone. Other similar types of regulating steps can also be used for affecting the flotation outcome, to a greater extent than in conventional flotation.

One observation made in the apparatus of the invention is that an increase of agitation power in the reactor zone decreases air consumption in flotation. The air consumption with an agitation intensity of 3 $kW/m^3$ of the reactor zone is only 30–50 $m^3/hm^2$, which is a little less than half of the amount of air used in conventional flotation technique.

BRIEF DESCRIPTION OF THE DRAWING

The apparatus of the invention is further described with reference to the appended drawings, where.

DESCRIPTION OF THE PREFERRED EMBODIMENTS

Figure 1:
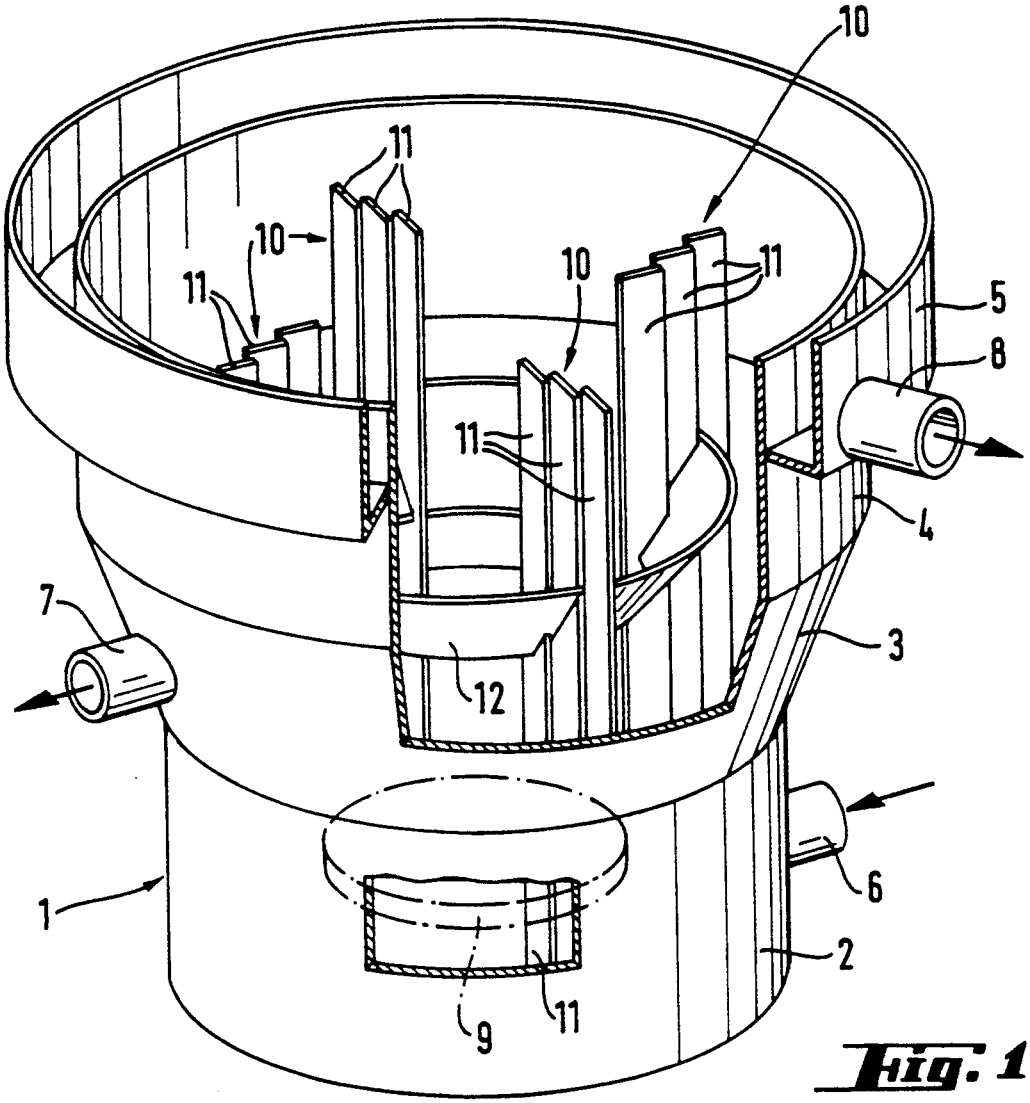
FIG. 1 is a diagonal axonometric illustration of a conditioning apparatus of the invention, seen in partial cross-section.

FIG. 1 illustrates a flotation apparatus 1 of the invention. The cell arrangement of the apparatus comprises three superimposed parts, lowermost the reactor part 2, and on top of it the intermediate part 3, which advantageously extends conically upwards. Topmost is the essentially vertical colon part 4. Around the colon part 4, there is provided the concentrate chute 5. In FIG. 1, the cell is cylindrical, but it can also be for instance hexagonal in cross-section. The height of the reactor part 2 with respect to the whole of the flotation apparatus 1 is between $\frac{1}{3}$–$\frac{2}{3}$. The slurry entering flotation is conducted, along the inlet pipe 6, to the reactor part of the flotation apparatus, near the bottom thereof. The waste ore from flotation is discharged through the outlet pipe 7 provided in the intermediate part 3. As was maintained above, the location of the outlet pipe in the vertical direction defines the time delay of the discharge of the ore waste. The flotated concentrate rises through the intermediate zone to the colon part 4 and is conducted, through the concentrate chute 5, to the concentrate outlet pipe 8.

FIG. 1 does not further illustrate the mixer particularly well suited to the said flotation apparatus, the so-called ORC mixer (ore to ready concentrate), but the area of operation of the mixer extends from the center outwards as far as the area indicated by the lines 9. The mixer is designed to be such that it increases the shearing speeds in the agitation; these shearing speeds are also deliberately caused by means of flow guides 10 stopping horizontal rotation flows. These flow guides are formed of radial horizontal lamellas 11 separated from each other by slots. In the drawing, the number of the said flow guides is 4, but advantageously their number is between 4 and 8, depending on the employed power of agitation. In the vertical direction, these flow guides extend from the bottom of the reactor part to the colon part, to the vicinity of the liquid surface.

In the bottom part of the intermediate section 3, there is used an agitation attenuator 12, which is composed of a cone structure. The cone is vertically movable along suspension shafts, so that in the intermediate section, the flows and the transversal surface of the flow area can be regulated by means of the flow guides and the agitation attenuator. The agitation attenuator, which extends to the region of the flow guides, distributes the flotation air onto the circumferential area of the colon part.

Figure 2:
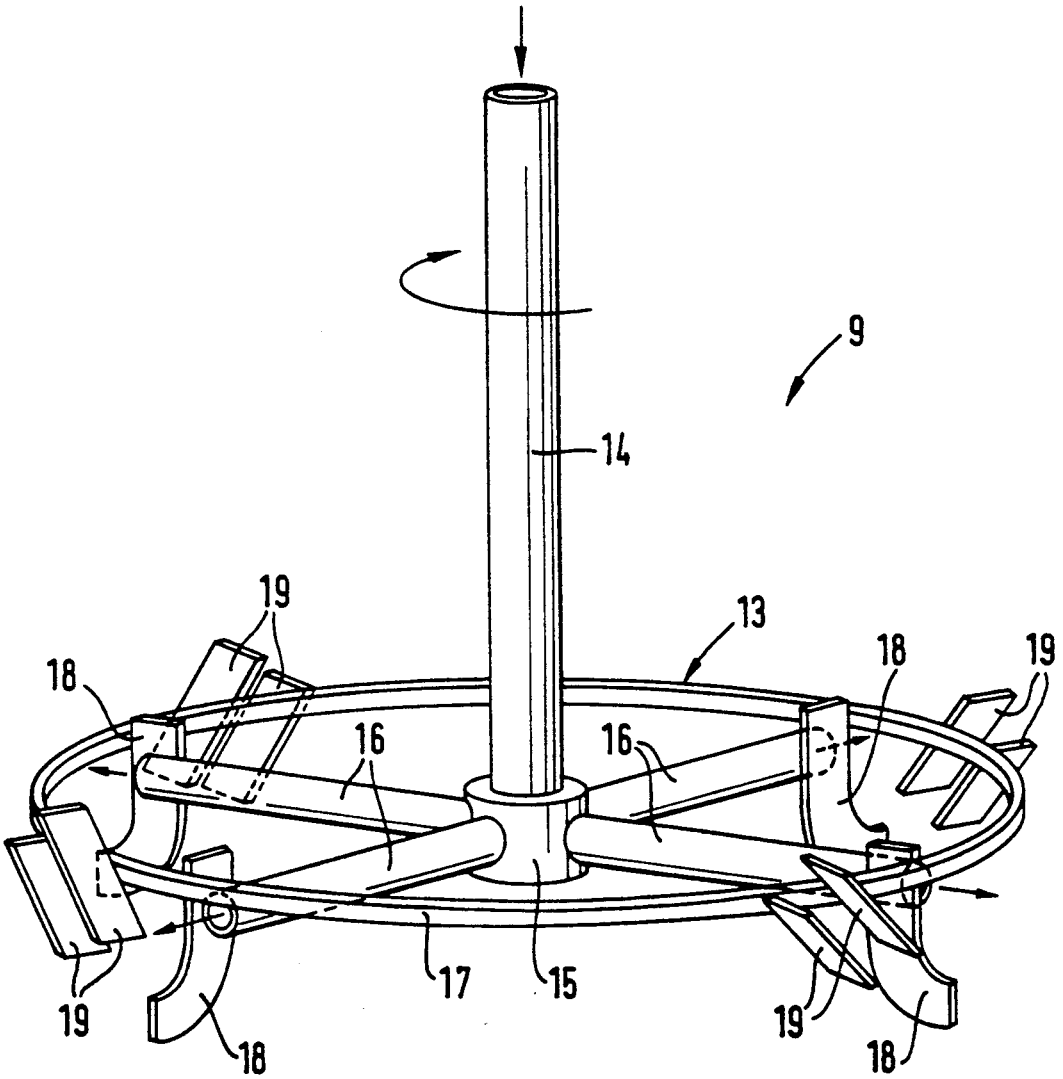
FIG. 2 is a diagonal axonometric illustration of an agitator suited in the apparatus of the invention.

FIG. 2 illustrates an ORC mixer 13, particularly well suited in the flotation apparatus of the invention. Flotation air is brought into the apparatus through the hollow axis 14 of the mixer. The ORC mixer is characterized by bladewise air supply, because the air entering through the axis 14 is conducted in through the mixer hub 15, which evens out the flow, and is divided into at least three support arms 16. The outermost ends of the support arms are attached to a support ring 17. The support arms 16 are directed horizontally outwards, or they can be downwardly inclined starting from the mixer hub. Either the support arms or the support ring is provided with vertical dispersion blades 18, parallel to the radius of the mixer. Thus the number of support arms and dispersion blades is the same, advantageously between 3–6.

The dispersion blades 18 are so installed that the air introduced through the support arms is fed to behind the dispersion blades, when seen in the rotation direction of the mixer. The blades 18 are vertically extended mainly downwardly with respect to the support arm and ring, which creates a strong down suction from the reactor bottom back to the mixer. At their bottom, the dispersion blades are bent to be directed horizontally outwards. At the same time, their transversal agitation area is advantageously narrowed. The narrow circumferential part of the blades increases the shearing speeds directed to the ore slurry in the region where the second set of blades, i.e. the shearingly pumping outer blades 19, have primary influence.

The outer blades 19 are located in pairs on the support ring in between the dispersion blades, and their number is the same as that of the dispersion blades, i.e. from three to six. The outer blades, which are installed at an angle of 40°–50°, advantageously 45° with respect to the horizontal level, urge the ore slurry downwards in an inclined fashion. The double blade structure improves the efficiency of pumping and increases the turbulence of the slurry sprays directed onto the mixer.

The shape of the outer blades is advantageously that of a parallelogram, and they are fastened to the outer edge of the support ring at their longer edge. The pairs of blades are so arranged that they are located at different heights with respect to each other, and at different distances with respect to the outer circumference of the support ring.

As was stated above, the intermediate zone 3 is provided with essentially vertical flow guides 10, which are formed of separate vertical lamellas 11. The single lamellas are mainly radial in direction, and are located in an overlapping fashion with respect to each other. When seen in the mixing direction, the lamellas are overlapping and can advantageously be radially extended over each other, as far as 0.20 times the width of one single lamella. In the mixing direction, adjacent lamellas are stepped for no more than the width of one lamella. The number of lamellas is between 4–10, and in the radial direction, the said flow guides extend at the most over a region with a width of 0.15 times the diameter of the reactor part 2. The outermost lamella is located at a distance from the wall of the reactor part, which distance is 0.025 times the reactor diameter at the most.

Figure 3:
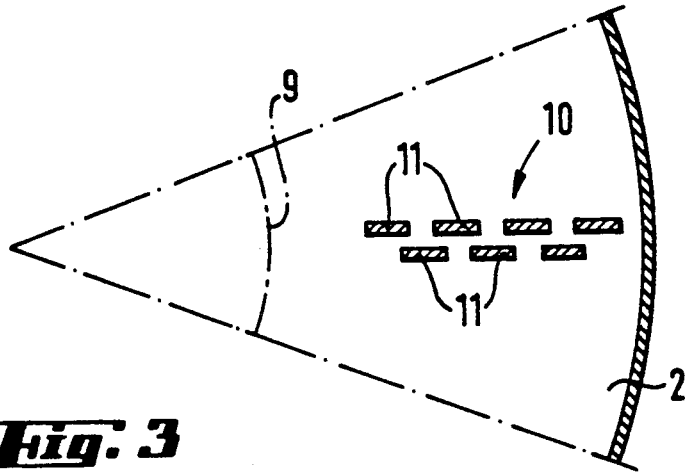
FIG. 3 is a cross-sectional illustration of one structural alternative for the flow guide of the flotation apparatus.

FIG. 3 illustrates an alternative for the above case; here the flow guide is radial but the adjacent lamellas 11 are in turns located on opposite sides of the radius.

The air-distributing flow attenuator 12 illustrated in FIG. 1 is composed of an upwardly widening cone structure 12. The cone extends to the region of the flow guides 10 and is notched at these. The inner diameter of the cone is 0.5–0.7 times the diameter of the reactor part, and the diameter is 0.6–0.8 times the diameter of the reactor part. The angle of the conical surface with respect to the horizontal level is 15°–45°. The cone can also be constructed so that its inner diameter is 0.7–0.8 times the diameter of the reactor part, and its outer diameter is 0.9–1.0 times the diameter of the reactor part. Thus the cone is notched at the bottom, at the flow guides 10. In the latter case the cone effectively closes the circumferential area between the wall of the reactor part and the intermediate part and the flow guides, and at the same time effectively attenuates the turbulent flow directed towards the colon part.

Figure 4:
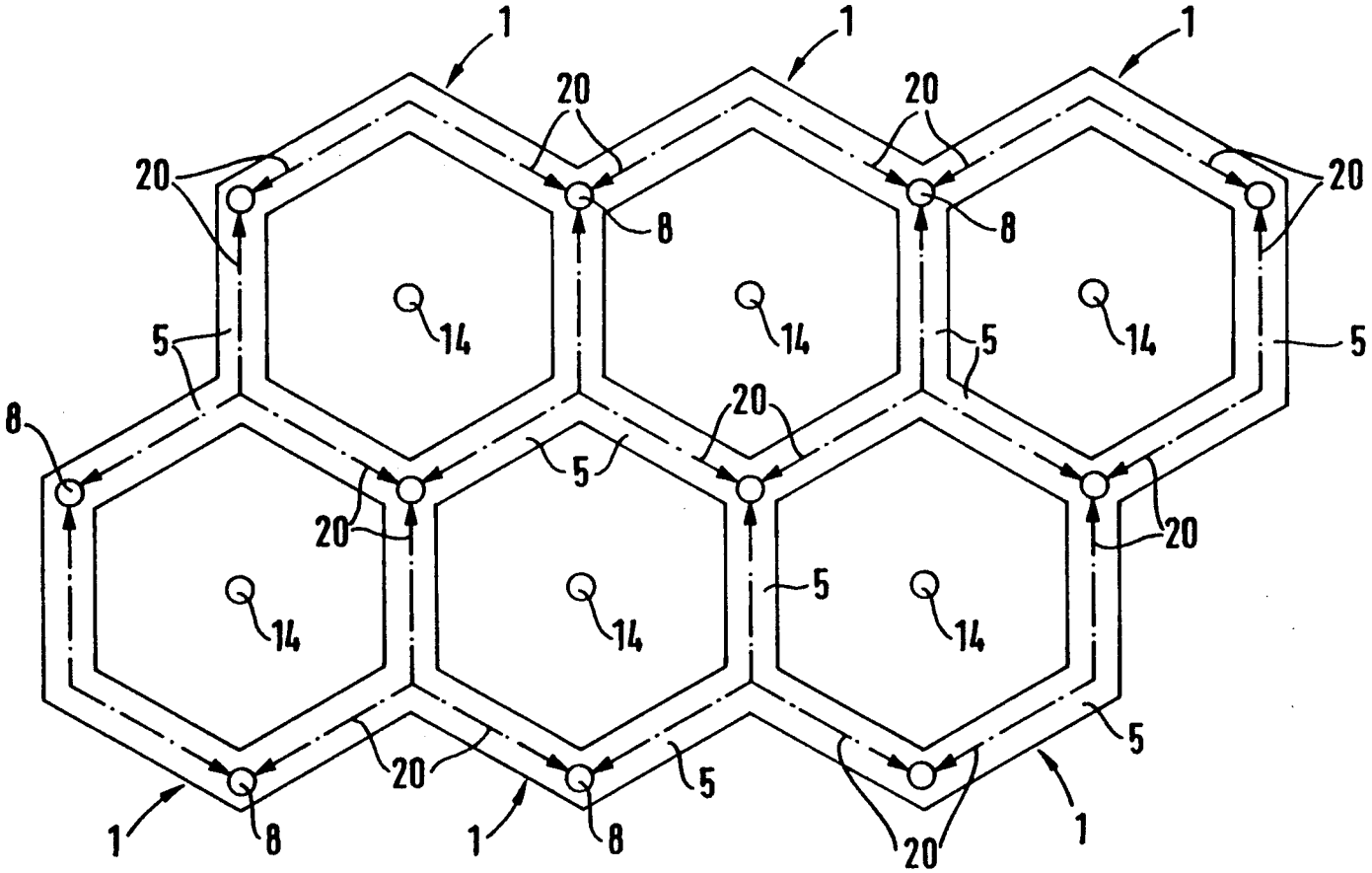
FIG. 4 is a drawing in principle of a combination of flotation apparatuses of the invention.

FIG. 4 is an illustration in principle of a case where flotation apparatuses which are hexagonal in cross-section are connected to each other. The arrows 20 point the direction in which the concentrate flowing from the chutes is conducted forward. As is seen, the arrangement is very economical as for the employed space. In a hexagonal cell, the flows are even more stable than in a cylindrical one.

The invention is further described with reference to the appended example:

EXAMPLE 1

In the performed experiments, it was studied how an increase in agitation intensity, i.e. the raising of shearing speeds, affects the flotatability of partly oxidized serpentine-type ore containing nickel, copper and iron sulphides. It is typical of the said slurry that in a conventional concentration apparatus, it requires a long conditioning period before concentrate begins to separate on the surface. Owing to its silicate content, this ore is at a flocculated state to such extent that flotation chemicals cannot directly affect single mineral particles or smaller formations thereof.

The flotation apparatus was of the type illustrated in FIG. 1, and the employed mixer was similar to the one in FIG. 2. The volume of the apparatus was 20 $m^3$, and the mixer diameter was 1150 mm. A series of flotation experiments was carried out in order to test different speeds of rotation. The employed speeds of rotation were 71, 96 and 115 rpm, among which the last corresponds to the power 2.0 $kW/m^3$, which is distinctly higher than the power normally used per this volume.

During the experiments, the test apparatus itself served as the first flotation unit in a continuously operated concentration plant. The experiments proved that with the lowest rpm, no concentrate was separated of the slurry. While using the medium rpm, the level where concentrate started to be separated onto the surface was just about reached. With the highest rpm, a generous amount of concentrate rose to the surface of the apparatus and flowed to the concentrate chute thereof.

We claim:

1. A method for concentrating ore slurry by means of powerful agitation and simultaneous flotation comprising concentrating the slurry in a flotation apparatus in three different stages, the flotation apparatus comprises a bottom cylindrical reactor section connected to an upwardly enlarging frustoconical intermediate section which is in turn connected to an uppermost cylindrical section, the method comprising causing the ore slurry to flow into said cylindrical reactor section along with air and subjecting the ore slurry and said air to powerful agitation; then allowing concentrate particles attached to air bubbles and waste slurry to rise upwards to said upwardly enlarging frustoconical intermediate section, the height of said intermediate section from $\frac{1}{3}$ to $\frac{2}{3}$ of the total height of the apparatus and discharging waste slurry from the apparatus at said intermediate section; adjusting the rising speed of said upwards flowing concentrate particles by means of flow guides formed of lamellas and a flow attenuator formed of an adjustable cone structure, so that in said uppermost cylindrical section of the apparatus the agitation falls within a region below 0.1 $kW/m^3$, so that flotated concentrate can be discharged through chutes provided around the uppermost section.

2. A method for concentrating ore slurry by means of powerful agitation and simultaneous flotation comprising concentrating the slurry in a flotation apparatus in three different stages, the flotation apparatus comprises a bottom hexagonal reactor section connected to an upwardly enlarging frustroconical intermediate section which is in turn connected an uppermost hexagonal section, the method comprising causing the ore slurry to flow into a hexagonal reactor section along with air and subjecting the ore slurry and said air to powerful agitation; then allowing concentrate particles attached to air bubbles and waste slurry to rise upwards to said upwardly enlarging frustroconical intermediate section, the height of said intermediate section being from $\frac{1}{3}$ to $\frac{2}{3}$ of the total height of the apparatus and discharging waste slurry from the apparatus at said intermediate section; adjusting the rising speed of said upwards flowing concentrate particles by means of flow guides formed of lamellas and a flow attenuator formed of an adjustable cone structure, so that in said uppermost hexagonal section of the apparatus the agitation falls within a region below 0.1 $kW/m^3$, so that flotated concentrate can be discharged through chutes provided around the uppermost section.

3. The method of claim 1 or 2 wherein the mixing power in the reactor section is 1.5–10 $kW/m^3$.

* * * * *